US009243556B2

(12) United States Patent
Abazid

(10) Patent No.: US 9,243,556 B2
(45) Date of Patent: Jan. 26, 2016

(54) TRANSMISSION MECHANISM FOR A VEHICLE INTERNAL COMBUSTION ENGINE

(71) Applicant: Mohammad Hesham Fayiz Abazid, Amman (JO)

(72) Inventor: Mohammad Hesham Fayiz Abazid, Amman (JO)

( * ) Notice: Subject to any disclaimer, the term of this patent is extended or adjusted under 35 U.S.C. 154(b) by 218 days.

(21) Appl. No.: 13/971,554

(22) Filed: Aug. 20, 2013

(65) Prior Publication Data

US 2015/0053168 A1 Feb. 26, 2015

(51) Int. Cl.

| | |
|---|---|
| ***F02B 75/32*** | (2006.01) |
| ***F02B 75/04*** | (2006.01) |
| *F01B 9/02* | (2006.01) |

(52) U.S. Cl.

CPC ..... *F02B 75/32* (2013.01); *F02B 75/045* (2013.01); *F01B 9/02* (2013.01)

(58) Field of Classification Search

CPC ..... F02B 75/32; F02B 59/00; F02B 75/045; F16C 7/06; F16C 7/02; F16C 7/023; F01B 9/02

USPC ..... 123/197.3, 197.1, 197.4; 74/579 R, 593

See application file for complete search history.

(56) References Cited

U.S. PATENT DOCUMENTS

| | | | | |
|---|---|---|---|---|
| 1,135,365 | A * | 4/1915 | Dock | 123/42 |
| 2,470,809 | A * | 5/1949 | Elants | 74/45 |
| 5,649,509 | A * | 7/1997 | Chang | 123/197.3 |
| 6,354,252 | B1 * | 3/2002 | Rabhi | 123/78 BA |
| 6,449,940 | B2 * | 9/2002 | Nagel | 60/39.63 |
| 7,137,365 | B2 * | 11/2006 | Maslen | 123/54.1 |
| 7,210,397 | B2 * | 5/2007 | Raffaele et al. | 92/140 |
| 7,814,881 | B2 * | 10/2010 | McRae | 123/197.4 |
| 8,720,393 | B2 * | 5/2014 | Tsay et al. | 123/48 B |
| 8,869,769 | B2 * | 10/2014 | Wilkins | 123/197.3 |
| 2002/0043226 | A1 * | 4/2002 | Gofron | 123/56.1 |
| 2010/0012095 | A1 * | 1/2010 | Wilkins | 123/48 B |
| 2012/0019005 | A1 * | 1/2012 | Wilkins | 290/1 A |

FOREIGN PATENT DOCUMENTS

| | | | | |
|---|---|---|---|---|
| CN | 202108591 | * | 1/2012 | F02B 75/32 |
| DE | 3129630 | A1 * | 2/1983 | F02B 75/32 |

* cited by examiner

*Primary Examiner* — Lindsay Low
*Assistant Examiner* — Grant Moubry
(74) *Attorney, Agent, or Firm* — Kelly K. Kordzik; Matheson Keys & Kordzik PLLC

(57) ABSTRACT

A mechanism for Internal Combustion (IC) engines, wherein such mechanism improves the efficiency and power output of IC engines through dividing the conventional connecting rod between the crank shaft and the piston into two parts; a first part and a second part, and connecting these parts together by a pin joint, wherein the second part slides through an oscillating rocker that is connected to an engine block by another pin joint, thus adding a degree of freedom to the conventional connecting rod. The mechanism may be retrofitted in an existing combustion engine without the need for any significant change in the design of the engine. The mechanism may replace the traditional connecting rod that connects the piston with the crank shaft of the engine and comprises essentially a primary connecting rod, a secondary connecting rod, and an oscillating rocker.

20 Claims, 8 Drawing Sheets

TRANSMISSION MECHANISM FOR A VEHICLE INTERNAL COMBUSTION ENGINE

BACKGROUND OF THE INVENTION

1. Field of the Invention

The field of the present invention relates to internal combustion engines' transmission mechanisms, especially to those which increase the efficiency to increase the output power of these engines with the same input, or increase the efficiency to reduce the fuel consumption at the same rated power.

2. Description of the Related Art

Transmission mechanisms that link the piston with the crank shaft of Internal Combustion (IC) engines are essential for such engines to function.

For this reason, numerous conventional transmission mechanisms have been presented in the prior art.

Among these solutions, a two-part piston for an IC engine is disclosed. This piston comprises an annular outer piston connected to the crankshaft by two connecting rods and an inner piston fit into the bore of the annular outer piston connected to the crankshaft by one connecting rod. The reciprocating motion of the inner and annular outer piston is controlled by the location of the respective connecting rod bearing journals on the crankshaft.

Another conventional solution discloses a hydraulic pump that includes a housing, at least two pistons mounted to the housing to rotate relative to the housing, and a transition arm coupled to each of the pistons to rotate therewith. The transition arm is set at a predetermined angle relative to a longitudinal axis of the pump. An adjustment mechanism sets the transition arm at the predetermined angle. A cylinder is mounted within the housing to rotate relative to the housing and defines pump cavities for receiving the pistons. A face valve defines inlet and outlet channels in fluid communication with the pump cavities. An apparatus for varying the output volume of a piston assembly includes at least two pistons, a transition arm coupled to each of the at least two pistons, and a rotatable member. The transition arm includes a nose pin, and the rotatable member is coupled to the transition arm nose pin. A radial position of the nose pin relative to an axis of rotation of the rotatable member is adjustable while the rotatable member remains axially stationary.

Another conventional solution discloses a piston crank mechanism provided with a planetary gear installed on a connecting rod of an engine, a primary gear for meshing with the planetary gear and outputting power, an output shaft for meshing with the planetary gear and outputting power to a clutch side, a ring gear meshed with the planetary gear and a cam shaft for turning the ring gear.

An alternative conventional solution discloses a high power converted IC engine without a crank shaft comprising a cylinder, a piston positioned inside the cylinder, and a transmission mechanism connected with the piston. The piston is connected with one end of the transmission mechanism; a push rod connected actively with the transmission loop is connected with the other end; the transmission loop is annular internal gear ring shaped as a runway and connected with a status keeping device, which keeps the translation track of the transmission loop to be as a runway; a main shaft gear of a power output main shaft is positioned and engaged to the transmission loop.

Another conventional solution discloses a drive mechanism for IC engine, which is a substitute mechanism for existent crank-linkage mechanism. It is characterized by that its power output mode lies in that using piston to drive rack rod, then using the rack rod to act on gear and in turn drive gear shaft to drive flywheel to deliver power.

The disclosed mechanisms and solutions found in the art have to be modified and enhanced in order to increase the efficiency of IC engines by increasing the output power of these engines with the input remaining the same.

SUMMARY OF THE INVENTION

Therefore, it is an object of the present invention to have a transmission mechanism for vehicle Internal combustion (IC) engines that connects a piston to a crank shaft.

It is another object of the present invention to have a transmission mechanism for vehicle IC engines that can be retrofitted in conventional vehicle IC engines without any significant change in the design of those engines.

Therefore, as an aspect of the present invention, there is provided a transmission mechanism for vehicle IC engines that increases the efficiency of those engines by increasing their output power while keeping the same input power.

It is another aspect of the present invention to increase the efficiency of the vehicle IC engines through adding a degree of freedom to the conventional connecting rod by dividing such rod into two parts; a primary connecting rod, and a secondary connecting rod, wherein such rods are connected through a pin joint.

Preferably, the transmission mechanism comprises a primary connecting rod, a secondary connecting rod, and an oscillating rocker connected to the cylinder body of the vehicle IC engine by a pin joint.

Preferably, the secondary connecting rod slides in said rocker.

Preferably, the primary connecting rod is connected to a piston of a vehicle IC engine from one of its ends, and to a secondary connecting rod from the other end.

Preferably, the secondary connecting rod slides in the oscillating rocker.

Preferably, the secondary connecting rod is connected to the crankshaft of the vehicle IC engine.

Preferably, the oscillating rocker is connected to the cylinder body of the vehicle IC engine by a pin joint.

BRIEF DESCRIPTION OF THE DRAWINGS

The invention will now be described with reference to the accompanying drawings, which illustrate a preferred embodiment of the present invention without restricting the scope of the invention, and in which.

DETAILED DESCRIPTION OF THE PREFERRED EMBODIMENT

Figure 1:
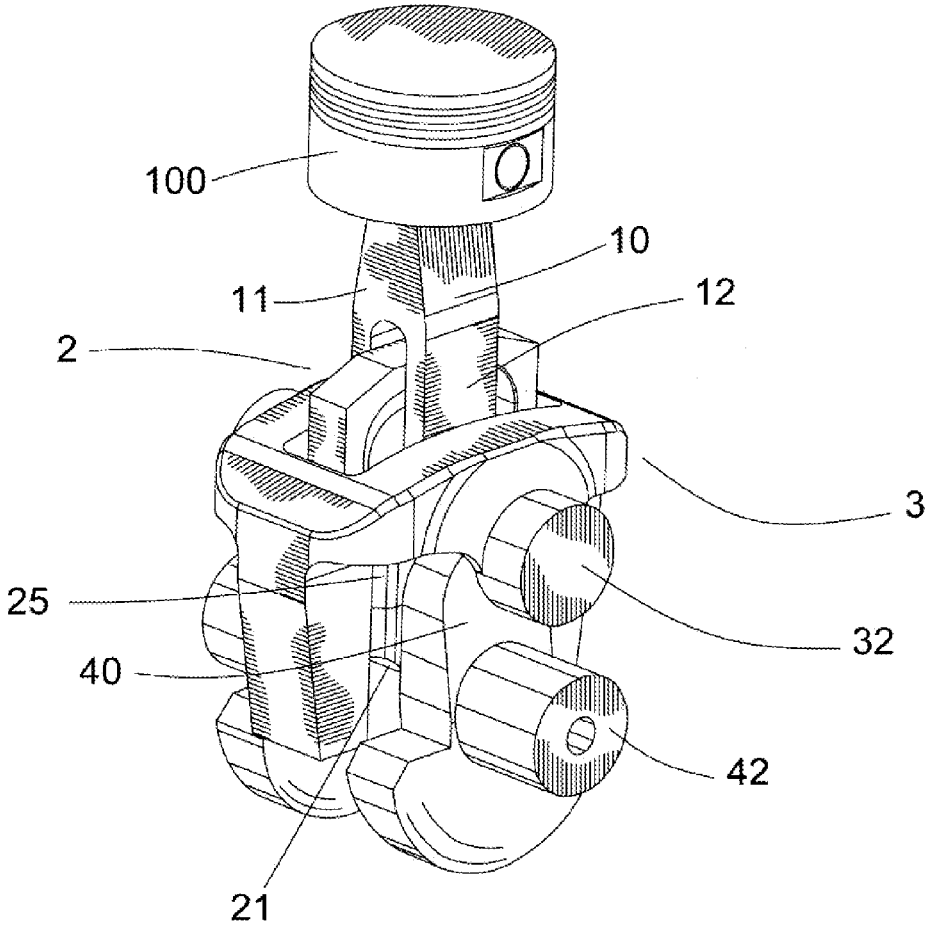
FIG. 1 illustrates a perspective view of a transmission mechanism for vehicle IC engines that links between the piston and the crankshaft of the engine with a piston, a part of a crankshaft, and a part of the engine cylinder configured according to a preferred embodiment of the present invention.
Figure 2:
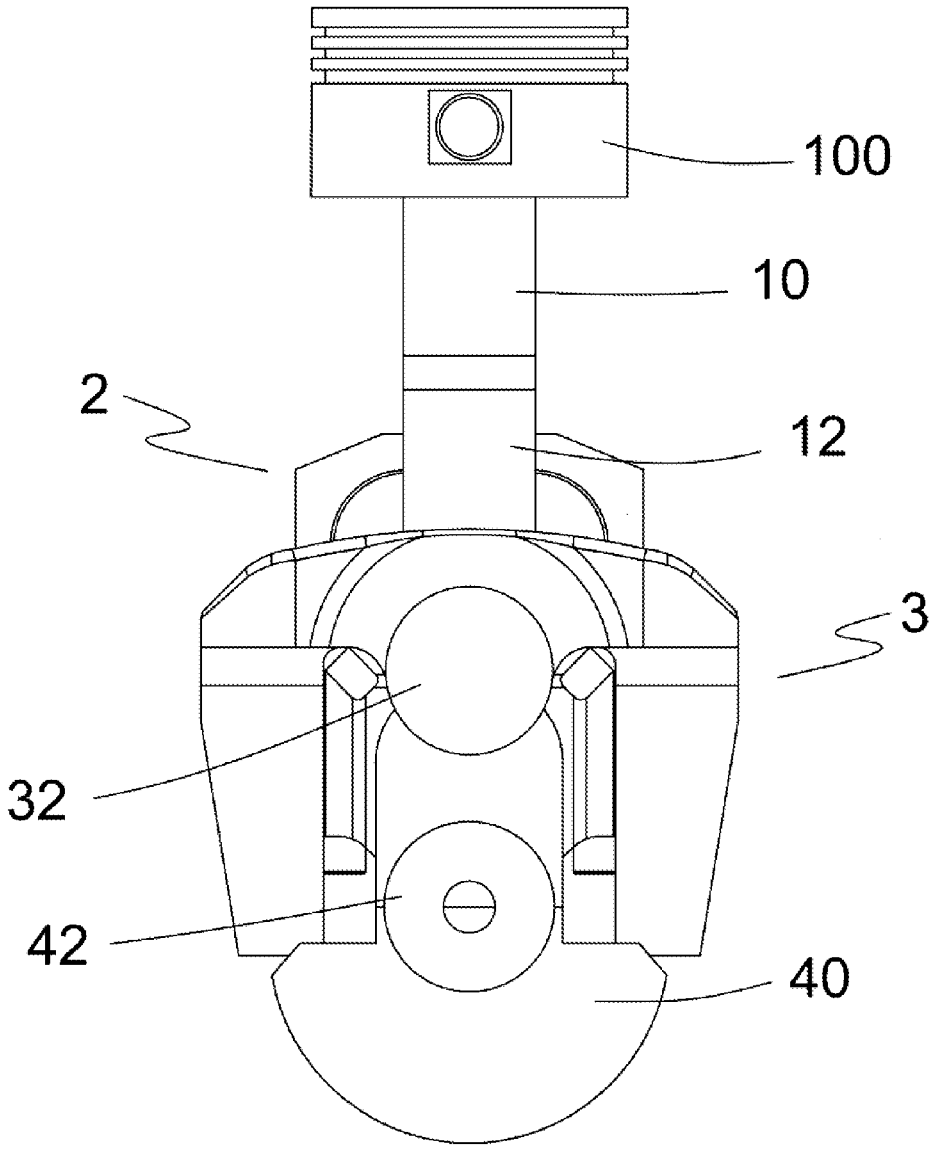
FIG. 2 illustrates a front view of a transmission mechanism for vehicle IC engines that links between the piston and the crankshaft of the engine connected to the piston and the crankshaft configured according to a preferred embodiment of the present invention.
Figure 3:
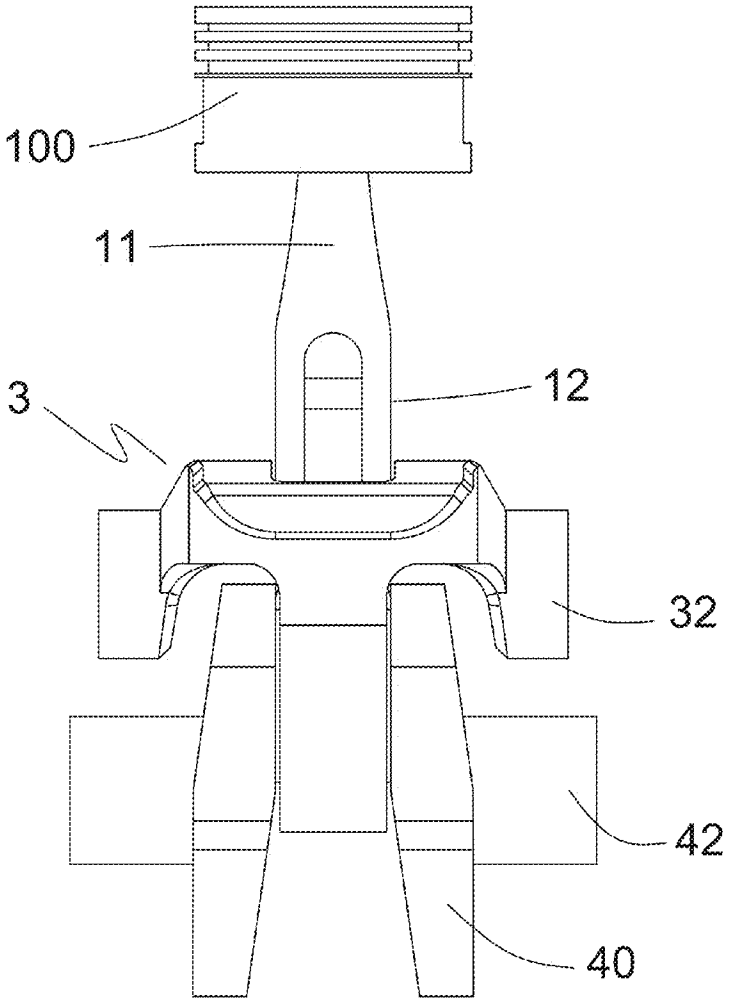
FIG. 3 illustrates a side view of a transmission mechanism for vehicle IC engines that links between the piston and the crankshaft of the engine connected to the piston and the crankshaft configured according to a preferred embodiment of the present invention.
Figure 4:
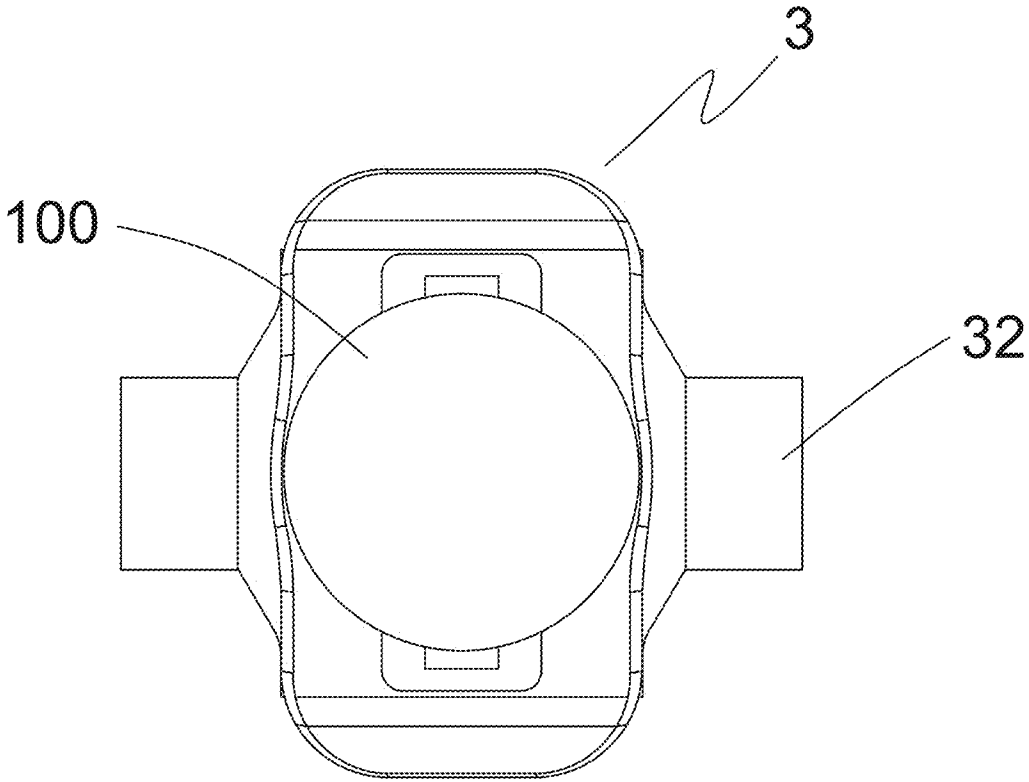
FIG. 4 illustrates a top view of a transmission mechanism for vehicle IC engines that links between the piston and the crankshaft of the engine connected to the piston and the crankshaft configured according to a preferred embodiment of the present invention.
Figure 5:
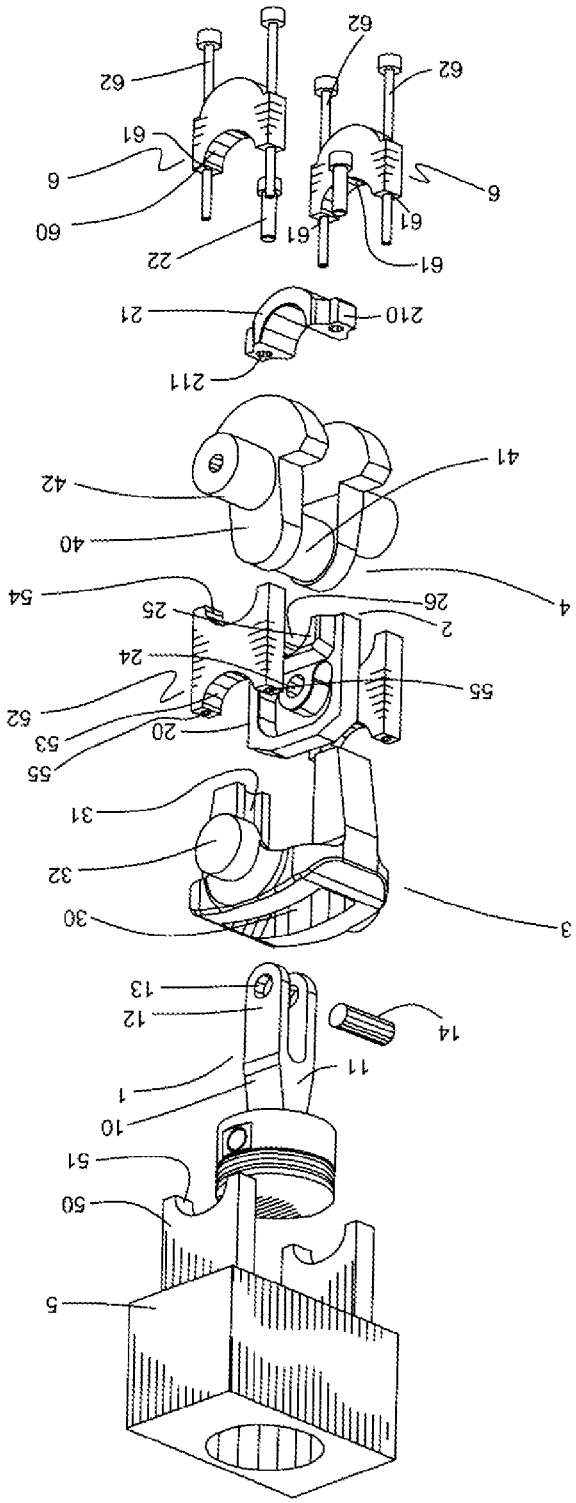
FIG. 5 illustrates an exploded view of a transmission mechanism for vehicle IC engines that links between the piston and the crankshaft of the engine configured according to a preferred embodiment of the present invention with an engine cylinder and connecting means that connect such transmission mechanism to such engine cylinder.

FIGS. 1-5 illustrate a transmission mechanism for vehicle IC engines that links between a piston and a crankshaft of the engine. Such mechanism is connected to a piston 100 and a crankshaft 42 and is configured according to a preferred embodiment of the present invention. This transmission mechanism comprises a primary connecting rod 1, a secondary connecting rod 2, an oscillating rocker 3, and a crank shaft has a plurality of mushroom-shaped pairs of counterweights 4. The primary connecting rod 1 has an upper portion and a lower portion, wherein the upper portion of the primary connecting rod is trapezoidal shape with two opposite inclined sides, and two opposite vertical sides 11. The upper portion of the primary connecting rod is connected to a piston of a vehicle IC engine. The lower portion of the primary connecting rod comprises two vertical extensions 12 pointing downwards, wherein such extensions has a space gap between them. Said extensions 12 have semi-circular ends, and each extension has a circular hole 13, wherein the central axes of the holes formed in the two extensions are collinear.

Said secondary connecting rod 2 comprises an upper portion 20 and a lower portion 21, wherein these portions are separable and are connected to each other by bolts 22. The upper portion of said secondary rod 20 has a rectangular shape with chamfered upper corners and drilled lower corners, wherein such portion has an n-shaped opening circumfusing a circular hole 24. The lower end of the upper portion of the secondary connecting rod 20 has an extension 25 pointing in the same direction as the central axis of the said circular hole 24 with a semi-circular opening 26. The lower portion 21 of the secondary rod has a semi-circular shape with two extensions 210 with two circular drilled holes 211 to enable the connection of the upper and lower portions 20 and 21 of the secondary connecting rod by the bolts 22.

The oscillating rocker 3 has an upper opening 30, two lateral guiding grooves 31, and a pair of oppositely positioned pin joints 32 with collinear axis. Said secondary connecting rod 2 is inserted in the oscillating rocker 3 and slides on said guiding grooves, wherein the oscillating rocker is connected to the engine's cylinder body 5 through the pair of pin joints 32. Such connection is achieved by making each pin joint of said pair of pin joints 32 in contact with a semicircular opening 51 of an extending member 50, and a semicircular opening 53 of a cylinder cap 52.

In the preferred embodiment of the present invention, the space gap found between the extensions 12 of the primary rod should have a size that permits the insertion of the upper portion of said secondary rod in such space gap. The primary connecting rod is connected to the upper portion of the secondary connecting rod 20 by a pin joint or any suitable connecting means inserted in the primary and secondary rods through said holes 13 and 24 when the central axes of these holes are collinear.

In the preferred embodiment of the present invention said circular holes 13 of the primary connecting rod 1 and said circular hole 24 of the upper portion 20 of the secondary connecting rod 2 should have the equal diameters.

The semi-circular holes' diameters of the upper and lowers portions 20 and 21 of said secondary connecting rod and the diameter of said crank shaft joint 41 are equal, wherein these portions are connected to each other when the crank shaft joint 41 is trapped between the two semi-circular holes in the upper and the lower portions of said secondary connecting rod.

In the preferred embodiment of the present invention, the linear distance between the center of the engine's crankshaft 42 and the center of the oscillating rocker pin 32, and the distance between the secondary connecting rod pins 24 and 26 are predetermined and are selected such that the piston's reciprocating motion is very fast near the top dead center and slow near the bottom dead center, with small angle of primary connecting rod 1 near the top dead center. Said crank shaft 42 is made in contact with two semi-circular holes 54 of said cylinder cap 52, and with two semi-circular holes 60 of a crank cap 6, wherein such contact is achieved in a way that said semi-circular holes 54 and 60 circumfuse said crank shaft 42.

In the transmission mechanism of the present invention, each of said cylinder cap 52 and said crank cap 6 has two holes 55 and 61 respectively, wherein such holes penetrates the whole length of such caps 52 and 6. Two bolts 62 are inserted in said holes 55 and 61 in order to fix said caps 52 and 6 to said extending member 51 of said cylinder.

The small angle of the primary connecting rod improves the mechanical efficiency of the vehicle IC engine, wherein such improvement is achieved by reducing the piston side load to very small amount compared to the piston side load in the conventional IC engines through adding a degree of freedom to the conventional connecting rod through dividing such rod into said primary connecting rod 1, a secondary connected rod 2, wherein such primary and secondary connecting rods are connected with each other by a pin joint 14. Also, the efficiency of the vehicle IC engines is improved in the transmission mechanism of the present invention through making the secondary connecting rod 2 oscillating in the grooves 31 of said rocker 3.

The transmission mechanism of the present invention can be retrofitted in conventional vehicle IC engines.

Figure 6A:
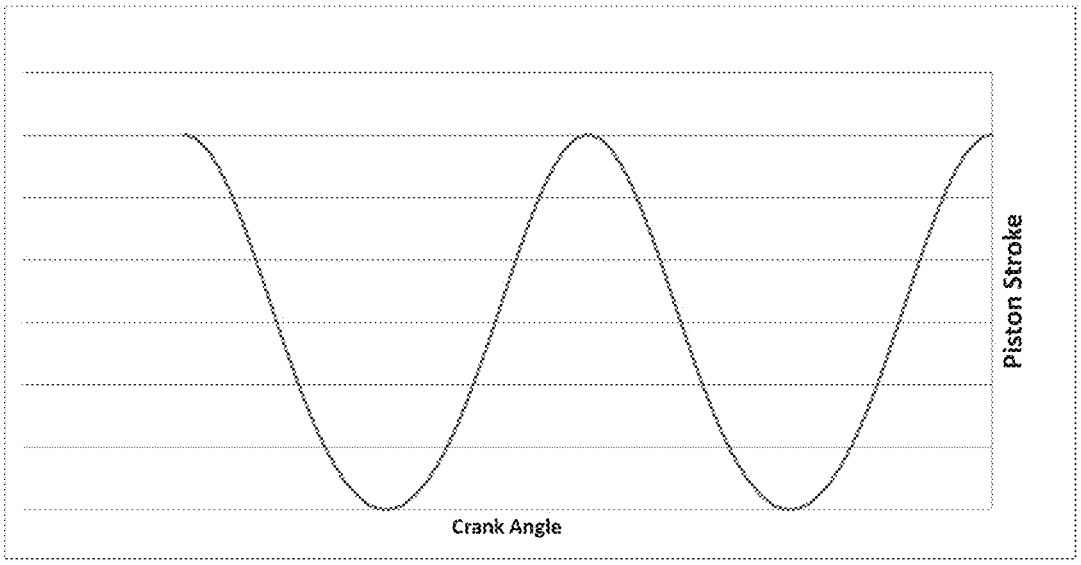
FIG. 6*a* illustrates a profile of a piston motion of a vehicle IC engine with a conventional transmission mechanism between such piston and a crankshaft of such IC engine.
Figure 6B:
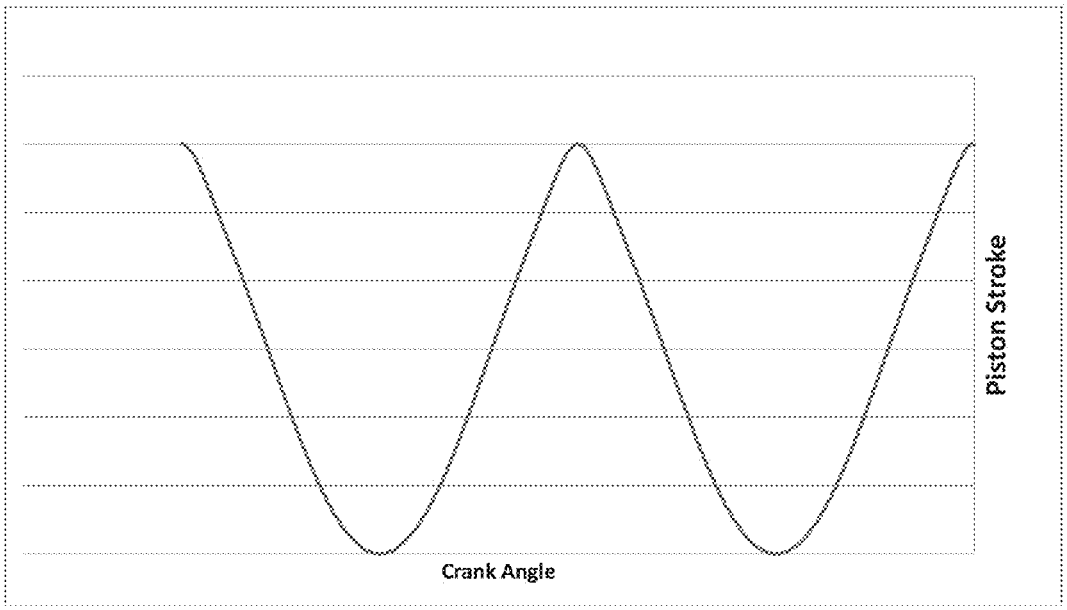
FIG. 6*b* illustrates a profile of a piston motion in a vehicle IC engine with the transmission mechanism of a preferred embodiment of the present invention installed in such IC engine.

FIG. 6*a* and *b* illustrate motion profiles for a piston of a vehicle IC engine before and after installing the transmission mechanism of the present invention. The transmission mechanism of the present invention increases the speed of the piston when the piston is substantially close to the top dead center, wherein such increase in speed shortens the combustion burn duration to be about 0.25 of the burn duration in conventional vehicle IC engines. The decrease in the burn duration enables the engine to have CR (Compression Ratio) of twice of what used in conventional one, wherein such doubling in the compression ratio results in improved thermal efficiency as same as improved rational efficiency. Also, the fast combustion with doubling in the compression ratio enables the use of lean-burn combustion strategies and significantly reduces the oxides of nitrogen (NOx) emissions without facing the problems of unstable combustion.

Figure 7:
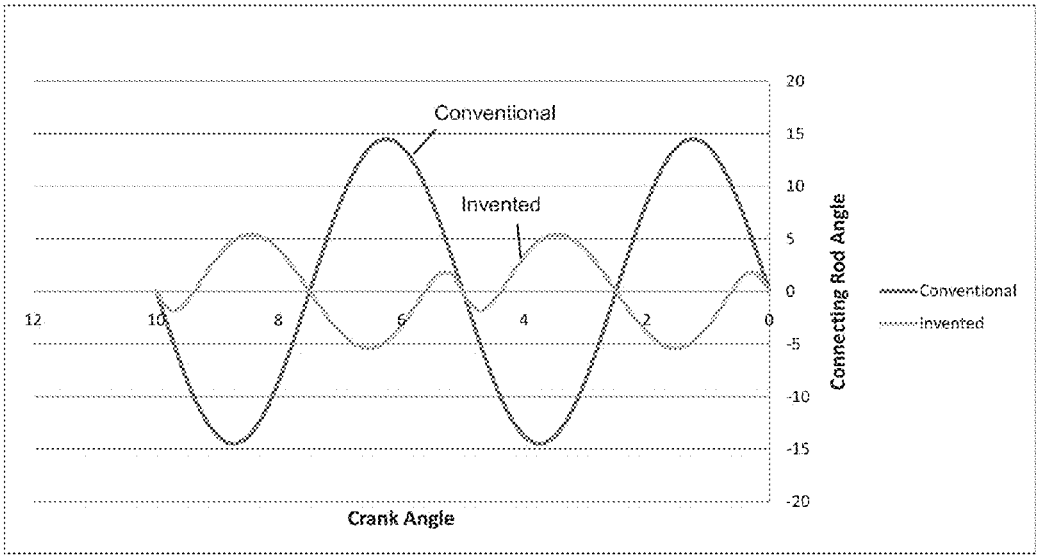
FIG. 7 illustrates the connecting rod angle versus the crank angle of a vehicle IC engine with and without the transmission mechanism of the present invention, wherein such transmission mechanism is configured according to a preferred embodiment of the present invention.

FIG. 7 illustrates a plot of the connecting rod angle versus crank angle of a vehicle IC engine with and without the transmission mechanism of the present invention. The angle using the transmission mechanism of the present invention is decreased in comparison with the conventional transmission mechanisms.

The transmission mechanism of the present invention is used in all the cylinders of the IC engine.

While the invention has been described in details and with reference to specific embodiments thereof, it will be apparent to one skilled in the art that various additions, omissions, and modifications can be made without departing from the spirit and scope thereof.

Although the above description contains many specificities, these should not be constructed as limitations on the scope of the invention but is merely representative of the presently preferred embodiment of this invention. The embodiment of the invention described above is intended to be exemplary only. The scope of the invention is therefore intended to be limited solely by the scope of the appended claims.

The invention claimed is:

1. A transmission mechanism for an Internal Combustion (IC) engine that links between a piston and a crank shaft of said engine and increases an efficiency of said engine through adding a degree of freedom to a conventional connecting rod by dividing it into two parts and controlling said degree of freedom by an oscillating rocker, said transmission mechanism comprising:

a primary connecting rod with an upper portion and a lower portion connected to the piston of said engine from the upper portion of said primary connecting rod;

a secondary connecting rod having an upper portion and a lower portion; the oscillating rocker with an opening at its top and two lateral guiding grooves; and the crank shaft having a mushroom-shaped pair of counterweights, wherein the secondary connecting rod upper and lower portions are connected to each other when a crank shaft joint is trapped between two semi-circular holes in each of said secondary rod upper and lower portions.

2. The transmission mechanism of claim 1, wherein the upper portion of said primary connecting rod is trapezoidal with two inclined opposite sides and two vertical opposite sides.

3. The transmission mechanism of claim 1, wherein the lower portion of said primary connecting rod comprises two opposite extensions pointing downwards having lower semi-circular ends with a space gap between said extensions.

4. The transmission mechanism of claim 3, wherein each of said extensions in the lower portion of said primary rod has a circular hole with collinear central axes.

5. The transmission mechanism of claim 1, wherein the upper portion of said secondary connecting rod is rectangular with chamfered upper corners and drilled lower corners.

6. The transmission mechanism of claim 1, wherein said upper portion of said secondary connecting rod has an n-shaped opening circumfusing a circular hole.

7. The transmission mechanism of claim 6, wherein said upper portion of said secondary connecting rod has an extension pointing in a same direction as a central axis of said circular hole with a semi-circular opening.

8. The transmission mechanism of claim 1, wherein the lower portion of said secondary connecting rod is semi-circular with two lateral extensions having circular holes.

9. The transmission mechanism of claim 1, wherein said upper portion and lower portion of said secondary connecting rod are separable and are connected with each other by bolts.

10. The transmission mechanism of claim 1, wherein said secondary connecting rod slides in said guiding grooves of said oscillating rocker.

11. The transmission mechanism of claim 1, wherein said oscillating rocker has two opposite pin joints with collinear axis connected to a body of an IC engine cylinder.

12. The transmission mechanism of claim 1, wherein circular holes of said primary connecting rod and a circular hole of said upper portion of said secondary connecting rod have equal diameters.

13. The transmission mechanism of claim 1, wherein said secondary connecting rod is inserted in a space gap between extensions in said primary connecting rod, and said secondary connecting rod and said primary connecting rod are connected to each other by a pin joint when circular holes of said lower portion of said primary connecting rod and a circular hole of said secondary connecting rod are collinear.

14. The transmission mechanism of claim 13, wherein said space gap between said extensions of said primary connecting rod has a size that permits the insertion of said secondary connecting rod in said space gap.

15. The transmission mechanism of claim 1, wherein said semi-circular holes of said secondary connecting rod and said crank shaft joint have equal diameters.

16. The transmission mechanism of claim 1, wherein said crank shaft joint is circumfused by the upper and lower portions of said secondary connecting rod.

17. The transmission mechanism of claim 1, wherein a speed of said piston at a substantially close position to a top dead center increases, and wherein said increase in speed shortens a combustion burn duration of said IC engine.

18. A mechanism for an engine configured for linking between a piston and a crank shaft of said engine, said mechanism comprising:

a primary connecting rod with an upper portion and a lower portion, said primary connecting rod configured for connecting to the piston from the upper portion of said primary connecting rod;

a secondary connecting rod having an upper portion and a lower portion; and an oscillating rocker with an opening at its top and guiding grooves, wherein said secondary connecting rod slides in said guiding grooves of said oscillating rocker, wherein the secondary connecting rod upper and lower portions are connected to each other when a crank shaft joint is trapped between two semi-circular holes in each of said secondary connecting rod upper and lower portions.

19. The mechanism of claim 18, wherein said oscillating rocker has two opposite pin joints with a collinear axis configured for connecting to a body of an engine cylinder.

20. The mechanism of claim 18, wherein said secondary connecting rod is inserted in a space gap between extensions in said primary connecting rod, and said secondary connecting rod and said primary connecting rod are connected to each other by a pin joint when circular holes of said lower portion of said primary connecting rod and a circular hole of said secondary connecting rod are collinear.

* * * * *